US006228013B1

(12) United States Patent
Mattka

(10) Patent No.: US 6,228,013 B1
(45) Date of Patent: May 8, 2001

(54) FOLDING MACHINE

(75) Inventor: Günter Mattka, Wildberg (DE)

(73) Assignee: Franz Gremser KG, Neusass (DE)

( * ) Notice: Subject to any disclaimer, the term of this patent is extended or adjusted under 35 U.S.C. 154(b) by 0 days.

(21) Appl. No.: 09/327,378

(22) Filed: Jun. 8, 1999

(30) Foreign Application Priority Data

Jul. 4, 1998 (DE) ..... 198 30 018

(51) Int. Cl.[7] ..... B31F 1/00
(52) U.S. Cl. ..... 493/417; 493/421; 493/476
(58) Field of Search ..... 493/417, 421, 493/398, 405, 408, 476, 475; 270/32, 39.06

(56) References Cited

U.S. PATENT DOCUMENTS 4,179,107 * 12/1979 Harris .
4,279,409 * 7/1981 Pemberton .
4,427,405 * 1/1984 Hoshi .
4,901,993 * 2/1990 Hansch .
5,377,965 * 1/1995 Mandel et al. .
5,405,127 * 4/1995 Welborn ..... 493/417
5,954,006 * 9/1999 Nishikawa et al. .
6,029,968 * 2/2000 Honegger .

* cited by examiner

*Primary Examiner*—Eugene Kim
(74) *Attorney, Agent, or Firm*—Jones, Tullar & Cooper, P.C.

(57) ABSTRACT

In a folding machine with at least two sequentially arranged folding stations rotated by 90° relative to each other, wherein a corner conveyor table is provided between the respective two sequentially arranged folding stations, and exhibits at least one straightedge that is situated at a right angle to the product direction of travel in the preceding folding station and can be spaced at variable distances relative to the output of the preceding folding station, along with a conveyor that leads alongside this straightedge, a gentle operating mode along with a high folding accuracy and ease of operation can be achieved by allocating a transfer device with an effective adjustable transport length to the straightedge of each corner conveyor table, wherein the transfer device supplies the products to it, and is connected to the output of the respective preceding folding station.

11 Claims, 3 Drawing Sheets

23
25
9
24
18
10
22
12
7
6
17
25
17
6
20
19
7
15
13
21
22
14
5
16

23
22
14
24
25
26
M
17
10
28
M
10
30
29
17
18
19
24
27
25a

FOLDING MACHINE

FIELD OF THE INVENTION

The present invention relates to a folding machine with at least two folding stations rotated by 90° relative to each other, sequentially arranged, in particular provided with pocket folders, wherein a corner conveyor table is provided between the respective two sequentially arranged folding stations, and exhibits at least one straightedge that is situated at a right angle to the product direction of travel in the preceding folding station and can be spaced at variable distances relative to the output of the preceding folding station, along with a conveyor that leads alongside this straightedge, preferably designed as a conveyor belt with outwardly open transverse slots connected with an air intake device in terms of flow.

PRIOR ART

Folding machines of the kind mentioned at the outset can be used to make so-called factory folded sheets, each with folds offset relative to each other by 90°, which is encountered in particular in the manufacture of books and booklets. The functional dimensions of the individual folding stations must here be adjusted to the dimensions of the largest product that passes through. The width of the first folding station corresponds to at least the width of the largest format to be processed. The width of the second folding station corresponds to at least half the format length. The width of the third folding station corresponds to at least half the format width. The width of the fourth folding station corresponds to at least one fourth of the original format length, and so on.

In the known arrangements of the kind mentioned at the outset, which are designed as single-flow machines, no transfer devices allocated to the straightedges have thus far been provided. In the known arrangements of the kind mentioned at the outset, which are designed for double flow, transfer devices are provided for one flow. However, these have fixed dimensions, wherein the width corresponds to half the width of the preceding folding station, and the length corresponds to half the width of the downstream folding station. As a result, the products run through all folding stations in a manner symmetrical to the center longitudinal plane only when processing printed sheets with the largest possible format. When processing smaller formats, passage through the folding stations becomes asymmetrical starting from the second folding station.

The printed sheets to be folded always pass through the first folding station symmetrical to the center longitudinal plane. However, the asymmetrical passage by the sheets through the remaining folding stations leads to a series of undesired disadvantages. For example, this results in an asymmetrical load on the folding rollers, folding pockets and curved points, and hence in a correspondingly asymmetrical wear on these parts, which reduces their life and negatively impacts the attainable quality. In addition, the asymmetrical passage by the sheets also has an unfavorable effect on the achievable precision. This becomes particularly evident in so-called zigzag folded sheets. To this end, the folding rollers must be set to the smallest sheet thickness up to the fold before last. Therefore, they must be pressed apart by the folding sheets, which get thicker and thicker. Given an asymmetrical load, the folding rollers do not remain parallel when they separate, but become inclined relative to one another, which has a negative impact on sheet guiding, and hence production accuracy. Another drawback is that the asymmetrical sheet passage also necessitates more adjustment work. Each format change requires that perforating and grooving blades along with sheet guiding elements be repositioned, which can be very time-consuming.

SUMMARY OF THE INVENTION

It is therefore the object of the present invention to improve a generic type arrangement with simple and cost-effective means in such a way that a sheet passage symmetrical to the center longitudinal plane of the respective folding station can be achieved in all folding stations and for all production conditions.

This object is achieved according to the present invention by allocating a transfer device with an effective adjustable transport length to the straightedge of each corner conveyor table, wherein the transfer device supplies the products to it, and is connected to the output of the respective preceding folding station.

These measures ensure that a transfer device is allocated to each flow for both single-flow and multiple-flow arrangements. Since their length is adjustable, a sheet passage through this folding station symmetrical to the center longitudinal plane of the respective folding station can be achieved, which ensures a uniform load, and hence wearing of the folding station elements, and precisely parallel folding rollers, along with a low adjustment effort. Another advantage to the measures according to the present invention lies in the fact that equally wide folding stations can readily be used without having to worry about the disadvantages described at the outset. Therefore, it is also advantageously possible to set up the sequential folding stations in parallel, which enables an increase in the number of possible parallel folded sheets. This also ensures a high variability.

The transfer devices can exhibit at least one rotating conveyor belt to which are allocated one reversing element adjustable in the longitudinal direction of the belt on the straightedge side, and at least one stationary reversing element on the folding station side, and which interacts with a fastening device. This results in a simple, straightforward and robust structural design for the transfer devices.

The transfer device can suitably exhibit two stationary reversing elements arranged in the area of the output of the corner conveyor table preceding the folding station. A strand of the allocated conveyor belt or allocated conveyor belts is allocated to these reversing elements, which also limit a compensation loop that is engaged by a fastening element moveable in the opposite direction to the reversing element on the straightedge side, against the effect of a restoring force. These measures advantageously enable a placement of the compensation loop in the area between the corner conveyor table and preceding folding station, thereby ensuring a high level of compactness.

In another advantageous measure, the feeding devices can each exhibit a sled adjustably mounted on a longitudinal guide parallel to the transport direction, which contains a shaft that forms the reversing element on the straightedge side. This enables an easy adjustment of the reversing element on the straightedge side, and hence the effective transport length of the accompanying transfer device.

The longitudinal guide can suitably exhibit two guide rails of varying length, wherein a sled is mounted on both guides, and exhibits a shaft extending over the width of the machine, and wherein additional sleds that extend only over part of the width of the machine can be cantilevered on the longer guide rails, if necessary. These measures simplify, in a beneficial manner, the retooling of multiple-flow production to single-flow production, and vice versa. To this end, all that need be done is remove or insert the shorter sleds.

DESCRIPTION OF THE PREFERRED EMBODIMENT

Figure 1:
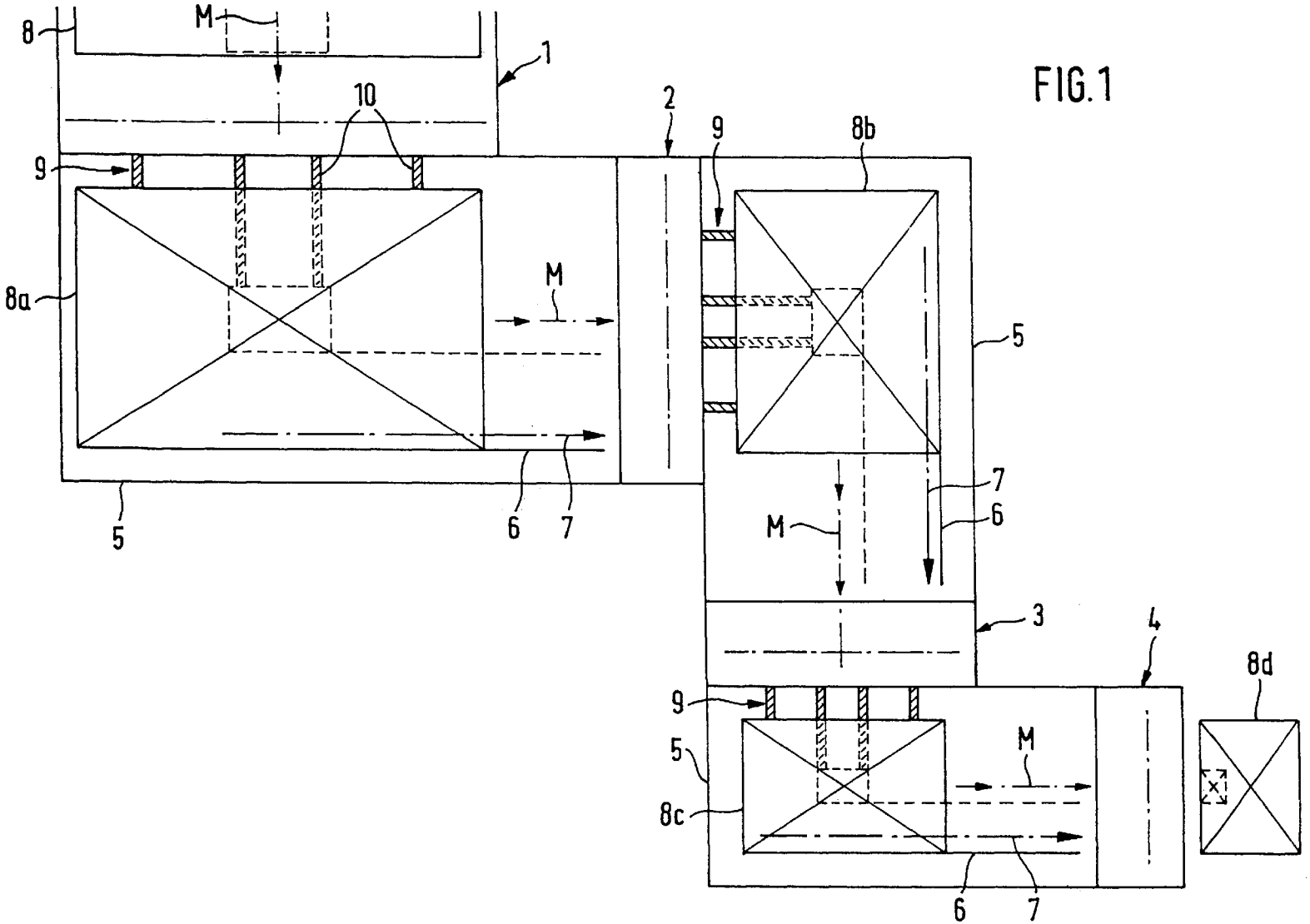
FIG. 1 is a schematic top view of an arrangement according to the present invention for single-use production with four folding stations.

The folding machine shown in FIG. 1 contains four folding stations 1, 2, 3, 4 rotated by 90° relative to each other, which can be provided with pocket folders in the manner known in the art. Arrangements of this kind are used to make so-called factory folded sheets, wherein 8, 16 or 32-page printed sheets are prepared for the manufacture of books or booklets via two to four folders rotated by 90° relative to each other. The functional dimensions of the individual folding stations are set proceeding from the largest format to be processed. In this case, the first folding station 1 has a working width that corresponds at least to the width of the largest format to be processed. The working width of the second folding station 2 corresponds at least to half the length of the largest format to be processed. The working width of the third folding station 3 corresponds at least to half the width of the largest format to be processed. The working width of the fourth folding station 4 corresponds at least to the half the working width of folding station 2, and hence to at least one-fourth the format length of the largest format to be processed. The folding stations 2 to 4 that follow the first folding station 1 are frequently designed to be wider as well, so that by being made parallel with the preceding station, the number of possible parallel folded sheets can be increased if needed.

Folding stations 2 and 4 are each preceded by a corner conveyor table 5 whose width corresponds at least to the working width of the next folding station, and whose length corresponds at least to the width of the preceding folding station. In the present example, the corner conveyor table 5 is suitably somewhat longer than the width of the preceding folding station. Each corner conveyor table here contains a straightedge 6 that runs parallel to the direction of the downstream folding station (only schematically indicated here). The distance between this straightedge and the output of the preceding folding station can be adjusted as a function of the size of the folding sheet passing through, and hence directly or indirectly as a function of the original sheet format. A conveyor 7 is allocated alongside each straightedge 6 (shown only by an arrow here), which feeds the sheet folded in the preceding folding station to the straightedge 6 and routes it to the downstream folding station.

When processing the largest possible sheet formats, the straightedges 6 are located in the area of the front edge of the allocated corner conveyor table 5 in the feed direction. When processing smaller formats, the straightedges 6 are adjusted against the feed direction. In FIG. 1, the maximal size of the products or intermediate products to be processed is indicated by solid lines, while the minimal size is indicated by broken lines. The respectively allocated straightedge is depicted in the same way. The unfolded sheets 8 always pass through the first folding station 1 symmetrically to the center longitudinal plane of folding station 1, regardless of their format. The straightedges 6 of the corner conveyor tables 5 adjustable in the direction of admission are set in such a way that the intermediate products 8*a*, 8*b*, 8*c* routed to it, which have already been folded one, two or three times, are fed to the folding stations 2 to 4 symmetrically to their center longitudinal plane. The straightedges 6 are here positioned in such a way as to be shifted by half the width of the intermediate product lying adjacent to them relative to the center longitudinal plane M of the downstream station. The end product 8*d* then is obtained symmetrically to the last folding station 4.

To ensure that intermediate products 8*a, b, c* are reliably fed to the respectively allocated straightedge 6, a transfer device 9 with an adjustable effective transport length connected to the output of the preceding folding station is allocated to each straightedge 6 of each corner conveyor table 5. The transfer devices 9 each consists of several conveyor belts 10 with a variable effective transport length distributed uniformly over the width of the intermediate product 8*a, b, c* to be transported. When processing large formats, the transfer devices 9 are set to their shortest transport length, as shown in FIG. 1. When processing the smallest sheet format, the transfer devices 9 are set to their longest transport length. In like manner, the effective width of the transfer devices 9 is reduced by removing unneeded transport belts 10 from the working area, e.g., pressing them to the side.

Figure 2:
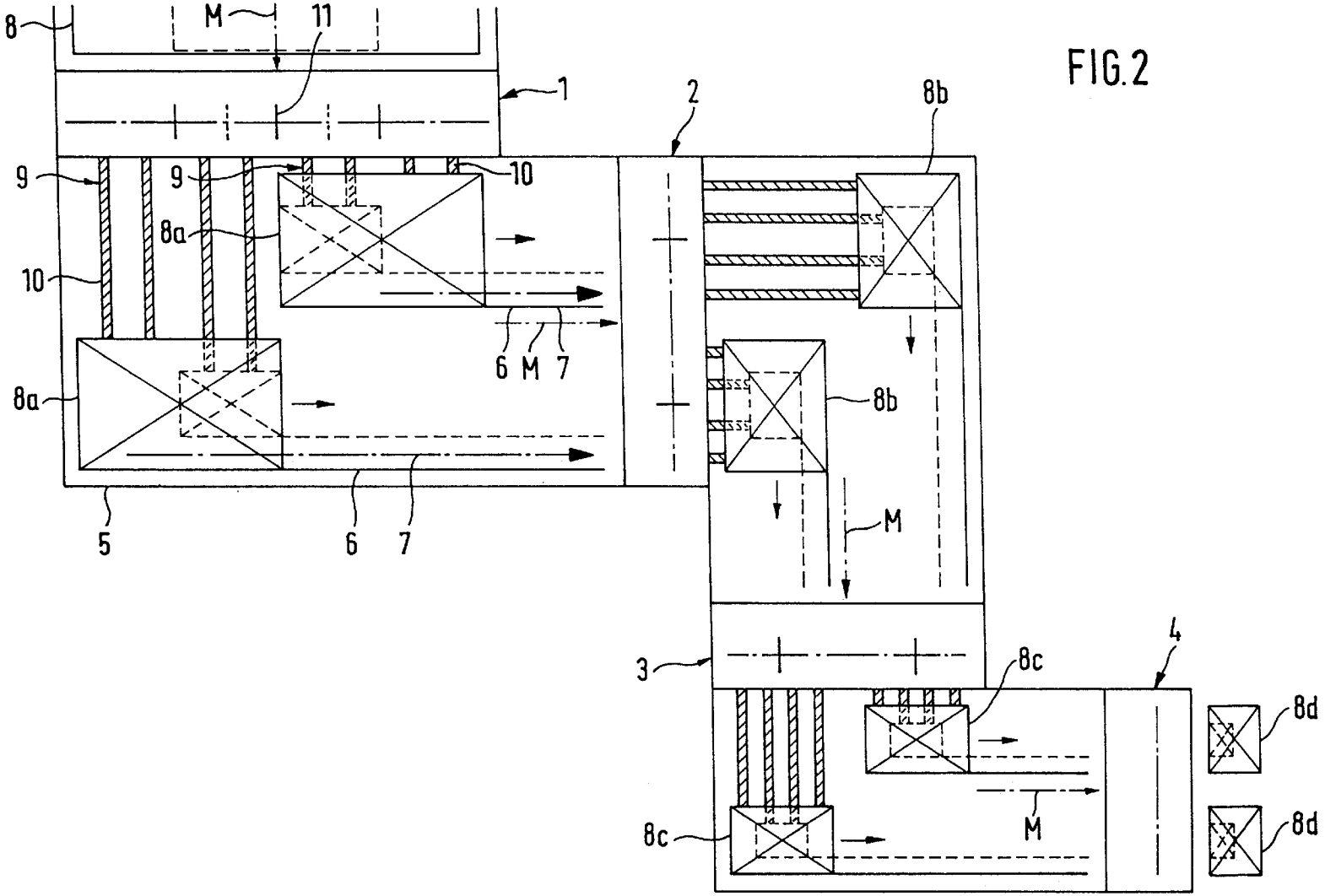
FIG. 2 is a schematic top view of an arrangement according to the present invention for dual-use production with four folding stations.

To process a high number of copies, folding machines of this kind are equipped with multiple-flow devices. FIG. 2 depicts a folding machine equipped with a double-flow device. The basic design of this folding machine corresponds to the arrangement according to FIG. 1. The same reference marks are therefore used for the same parts.

In the arrangement according to FIG. 2, a cutting device 11 is provided in the area of the outlet of the first folding station 1. This cutting device 11 divides the folding sheets 8 passing through the first folding station 1 into two equal intermediate products 8*a*. Correspondingly, the next corner conveyor table 5 has two intermediate products 8*b*, and the one after has two intermediate products 8*c*. Two end products 8*d* are obtained at the output of the last folding station 4. In multiple-flow devices, several cutting devices are provided at the output of the first station. Corresponding grooving and/or perforating devices can be provided at the other stations. Each corner conveyor table 5 has a number of straightedges 6 corresponding to the number of intermediate products fed to it. Each straightedge is allocated to an intermediate product flow. In the depicted example with dual-use production, then, two straightedges 6 are provided, arranged in such a way that intermediate products 8*a* or 8*b* or 8*c* fed to it are aligned here and can be routed away collision-free as parallel flows, exiting at a right angle to the feeding device.

Correspondingly, there is a straightedge 6 in the area of the front half of the corner conveyor table 5 in the feeding direction and an additional straightedge 6 in the area of the back half of the corner conveyor table 5 in the feeding direction. This shift in the direction of admission makes it possible to transport away the intermediate products fed to the corner conveyor table 5 in the form of side-by-side flows. Correspondingly, the back straightedge 6 in the direction of admission is shortened relative to the front straightedge 6 in the transport direction. The latter extends practically over the entire length of the allocated corner conveyor table 5. The back straightedge 6 in the transport direction extends at most to the position of the center longitudinal plane of the preceding folding station. Conveyors 7 are allocated to both straightedges 6, passing alongside them. These can be adjusted in tandem with the respective straightedge within the allocated table half.

The transfer device 9 allocated to the front straightedge 6 in the direction of admission is longer than the transfer device 9 allocated to the back straightedge in the direction of admission. The longer transfer device 9 passes alongside the back straightedge in the direction of admission, which is shortened, as mentioned above, relative to the front straightedge 6. The straightedges 6 and respectively allocated transfer devices 9 are adjustable depending on the format, as in the above example. This adjustment takes place by routing the product flows fed to the two straightedges 6 of a corner conveyor table 5 to the downstream folding station in the form of flows positioned symmetrically to the center longitudinal plane M of this folding station, and having these product flows pass through this folding station correspondingly symmetrical to the center longitudinal plane. In this case, both partial flows can be routed away from the corner conveyor table 5, centrally relative to the respectively allocated half of the conveyor table. This is indicated in FIG. 2, wherein the same applies for adjusting the straightedge 6 as in the above example, except that only the allocated half of the corner conveyor table is considered instead of the entire corner conveyor table. However, it would also be conceivable to adjust the straightedge 6 and the transfer devices 9 allocated to them in such a way that the two partial flows leaving a corner conveyor table 5 are edged closer to the center longitudinal plane M or shifted farther to the outside relative to the position according to FIG. 2. A position symmetrical to the center longitudinal plane of the respectively admitted folding station is always obtained, i.e., equal distances from the center longitudinal plane M.

Figure 3:
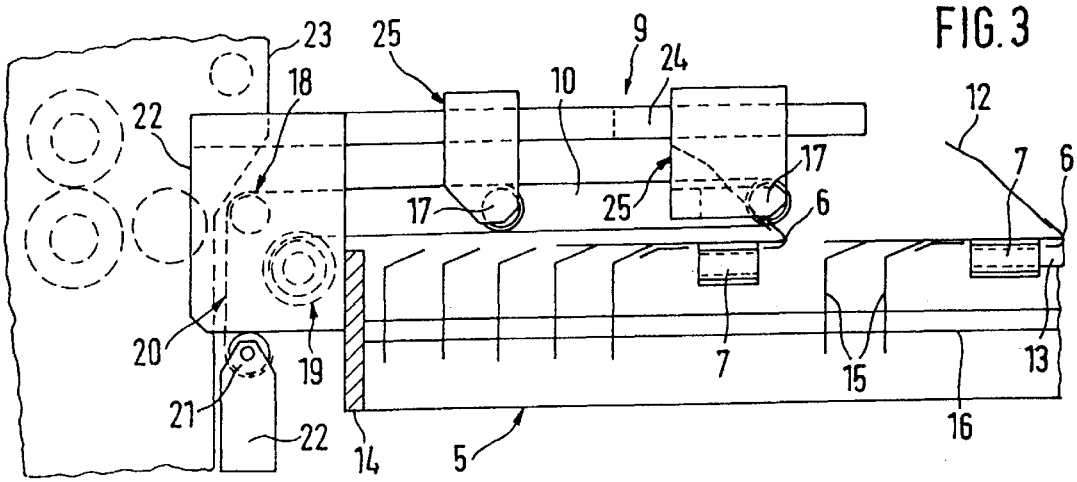
FIG. 3 is a side view of a corner conveyor table of the arrangement according to FIG. 2 set up for dual-use production.

As best visible from FIG. 3, the straightedges 6 are formed by mounting channels exhibiting a laterally open channel, on whose upwardly facing leg a catching sheet 12 can be secured. The conveyor 7 allocated to each straightedge 6 can suitably consist of a conveyor belt with outwardly open transverse slots connected with an air intake device 13 in terms of flow. Such a conveyor can be formed simply by using a toothed belt, which is received on the corresponding pulleys in reverse, i.e., with outwardly pointing teeth. The conveyor 7 is suitably lightly prestressed relative to the allocated straightedge 6, so that the respectively collected products are reliably put against the straightedge 6. The straightedge 6 and respectively allocated transport device 7 can be combined into a jointly adjustable unit.

The corner conveyor table 5 has a rotating frame 14, which is compartmented by straightedge-parallel lamellae 15 that overlap each other like scales, wherein these lamellae are adjustably incorporated on a guide 16 that penetrates the frame 14.

Figure 4:
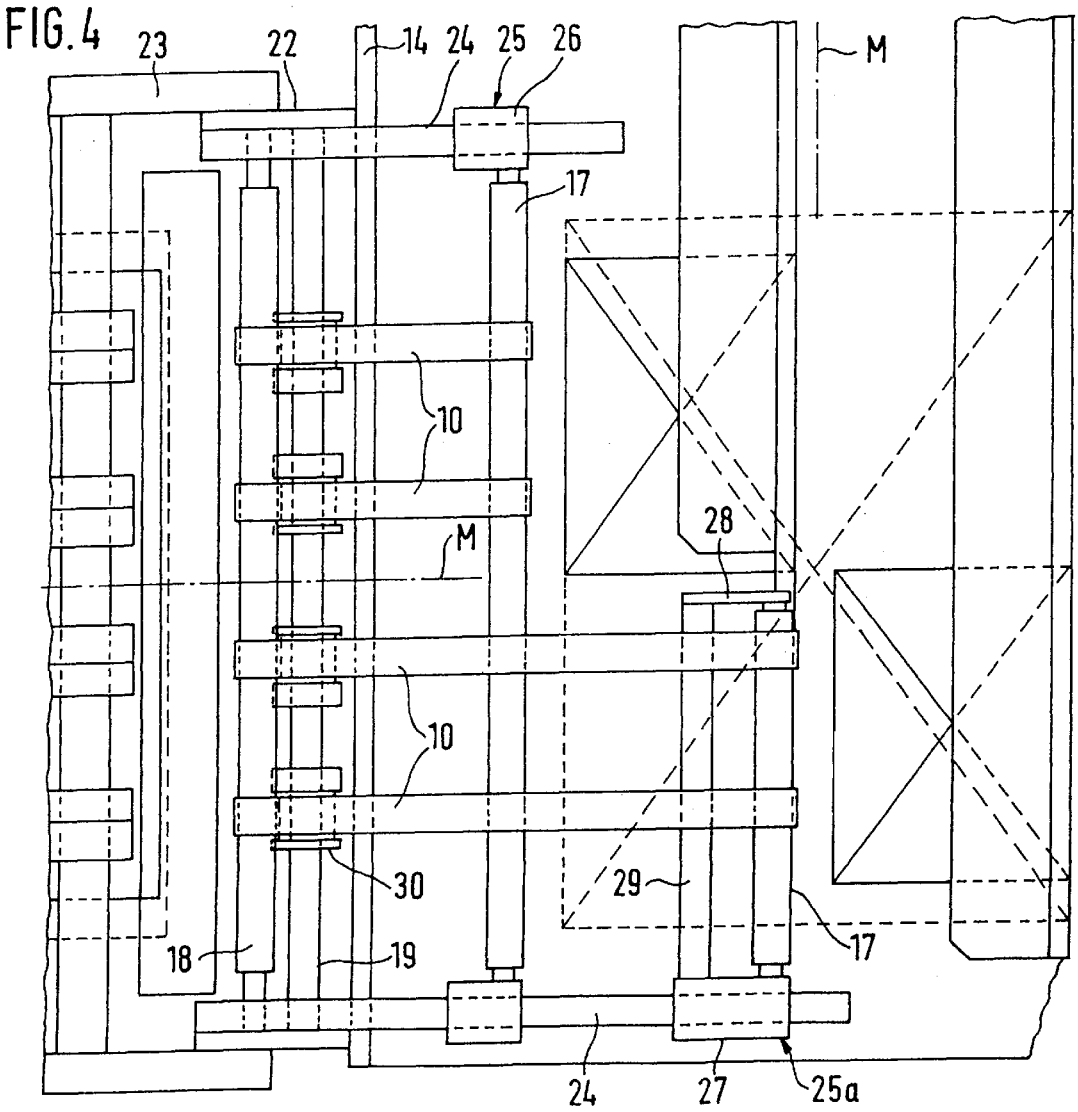
FIG. 4 is a top view of the arrangement according to FIG. 3.

The corner conveyor table shown on FIGS. 3 and 4 is set up for dual-use production. Accordingly, two straightedges 6 are provided, with a transfer device 9 allocated to each. As already described above, the transfer devices 9 exhibit several side-by-side conveyor belts 10, which are reversed by reversing elements located on the straightedge side and in the area of the outlet of the respectively preceding folding station. The conveyor belts 10 are distributed over the width of the flow to be transported. The front, straightedge-side reversing element 17 in the transport direction of the transfer device 9 is adjustably mounted in a transport direction, which makes it possible to set the effective transport length of the allocated transfer device 9.

Situated in the area of the outlet of the preceding folding station are two stationary reversing elements 18, 19, via which a strand of the conveyor belts 10 is routed, thus resulting in a compensation loop 20 that runs at about a right angle to the transport path. This compensation loop is engaged by a moveable tightening roller 21, which is exposed to a restoring force generated by means of a weight 22. The tightening roller 21 is moveable in practically an opposite direction to the front reversing element 17. The compensation loop 20 is located in the area between the frame 14 of the corner conveyor table 5 and the rack of the preceding folding station, which results in a space-saving arrangement.

Stationary reversing elements 18, 19 extend over the entire table width, and are mounted on two lateral end plates 22, which can be secured to the side walls 23 of the preceding folding station. Of course, the end plates 22 can also be fastened to the frame 14. The end plates 22 also accommodate lateral guide rails 24 that run in the transport direction. These form a longitudinal guide on which the sleds 25 allocated to the front reversing elements 17 are moveably and adjustably mounted. The sled 25 allocated to the back straightedge 6 in the feeding direction has two followers 26 each mounted on the guide rails 24. The two followers 26 are bridged by a shaft extending over the entire table width, which forms the front reversing element 17 of the transfer device 9 allocated to the back straightedge 6 in the feeding direction.

In arrangements with single-use processing, only this sled 25 is provided, wherein conveyor belts distributed over the entire length of the continuous shaft can be provided.

In the example shown with dual-use processing, a second, shorter sled 25*a* is provided. This sled is cantilevered on the adjacent guide rail 24. This guide rail is longer than the opposing guide rail, as evident from FIG. 4. The sled 25*a* has a shortened shaft relative to the continuous shaft of sled 25, which forms the front reversing element 17 of the allocated transfer device 9. This shaft is mounted on a runner 27 secured in a tilt-resistant manner on the one hand, and on a support bracket 28 connected with the runner 27 via a supporting cross arm 29 on the other. As already mentioned above, the stationary reversing elements 18, 19 cover the entire width, and are used to reverse the transport conveyor belts 10 of the side-by-side transfer devices 9, whose width corresponds to a maximum of half the width of the preceding folding station. When switching from dual-use to single-use production, the shorter sled 25*a* and shorter straightedge 6 along with the allocated catching sheet 12 are simply removed. the conveyor belts can remain, and are put against the reversing element 17 of the longer sled 25 by the allocated fastening devices. At least the detachable straightedge 6 can be attached to the allocated module via a plug connector, and is therefore easy to remove. The catching plate 12 is secured to the allocated straightedge 6. The existing conveyor belts are uniformly distributed over the length of the longer sled 25.

The transport belts 10 that form the transfer devices 9 can suitably be driven by an allocated infinitely variable drive motor, which can be advantageously synchronized with the preceding folding station. The infinitely variable drive makes it possible to precisely adjust the speed of the transfer device independently of the speed of the preceding folding station. The synchronization results in an automatic correction when running up or down the machine speed. However, it would also be conceivable to simply have driving take place from the outlet shaft of the preceding folding station. A reversing element with suitable guide rollers or grooves can be provided to secure the track of the transport belts 10. In the example shown, the stationary reversing element 19 allocated to the lower strand of the transport belts 10 is provided with rollers 30 accommodated on a continuous carrier. If the carrier is designed as a driven shaft, the rollers 30 are securely connected thereto. The conveyor belts 10 can be designed as toothed belts to which suitable toothed belt disks are allocated at least on the drive side, which results in a non-slip running.

What is claimed is:

1. A folding machine having: at least two folding stations each defining a product direction of travel, and each rotated by 90° relative to each other, and sequentially arranged, each folding station being provided with pocket folders; a corner conveyor table provided between two respective sequentially arranged folding stations each corner conveyor table having at least one straightedge that is situated at a right angle to the product direction of travel in the preceeding folding station and can be spaced at variable distances relative to the output of the preceeding folding station; a conveyor that leads alongside this straightedge and comprises a conveyor belt with outwardly open transverse slots connected with an air intake device in terms of flow; and a transfer device with an effective adjustable transport length allocated to the straightedge of each corner conveyor table, wherein the transfer device supplies products to the folding machine, and is connected to the output of the respective preceding folding station said transfer device having on rotating conveyor belt to which are allocated one reversing element adjustable in the longitudinal direction of the belt on the straightedge side, and at least one stationary reversing element on the folding station side, which interacts with a fastening device.

2. The folding machine according to claim 1, wherein each conveyor belt runs through a compensation loop, to which is allocated a fastening element moveable in the opposite direction to the reversing element on the straightedge side, against the effect of a restoring force.

3. Folding machine according to claim 1, wherein the transfer device that has two stationary reversing element arranged in the area of the output of the corner conveyor table preceeding the folding station, to which is allocated a strand of each conveyor belt, and which also limit the compensation loop.

4. The folding machine according to claim 1, wherein several side-by-side, adjustable transfer devices are provided over the width of the output of each folding station preceeding a corner conveyor table, which has a varying length and are allocated to straightedges of different length, wherein the straightedges allocated to the longer transfer device covers the output width of the preceeding folding station, wherein each additional straightedge is shortened relative to the respective downstream straightedge by the width of the transfer device allocated to it.

5. The folding machine according to claim 1, wherein each transfer device has a sled adjustably mounted on a longitudinal guide parallel to the transport direction, which contains a shaft that forms the reversing element on the straightedge side of the accompanying transfer device.

6. The folding machine according to claim 5, wherein a joint longitudinal guide is allocated to the side0by-side transfer device of a corner conveyor table.

7. The folding machine according to claim 5, wherein the longitudinal guide has two guide rails of varying length, wherein a sled is mounted on both guides, and has a shaft extending over the table width, and wherein all additional sleds that extend only over part of the table width can be cantilevered on the longer side rails.

8. The folding machine according to claim 6, wherein the guide rails are attached to two side end plates that are secured to an adjacent casing element, and accommodate the stationary reversing elements.

9. The folding machine according to claim 1, wherein the conveyor belts of the transfer devices are driven by an infinitely variable driving device.

10. The folding machine according to claim 9, wherein the driving device allocated to the conveyor belts is synchronized with the respective preceeding folding station.

11. The folding machine according to claim 1, wherein the corner conveyor table has straightedge-parallel lamellae that overlaps each other like scales, and wherein these lamellae are incorporated on a guide in a reciprocally moveable manner.

* * * * *